US006497790B2

(12) United States Patent
Mohan et al.

(10) Patent No.: US 6,497,790 B2
(45) Date of Patent: Dec. 24, 2002

(54) PAPERBOARD OF IMPROVED SMOOTHNESS AND BULK

(75) Inventors: K. Krishna Mohan, Staten Island, NY (US); Michael J. Smith, Tuxedo Park, NY (US); Alexander A. Koukoulas, Ridgewood, NJ (US)

(73) Assignee: International Paper Company, Stamford, CT (US)

( * ) Notice: Subject to any disclaimer, the term of this patent is extended or adjusted under 35 U.S.C. 154(b) by 0 days.

(21) Appl. No.: 09/877,614

(22) Filed: Jun. 8, 2001

(65) Prior Publication Data

US 2002/0060005 A1 May 23, 2002

Related U.S. Application Data

(62) Division of application No. 09/158,483, filed on Sep. 22, 1998, now Pat. No. 6,287,424.

(51) Int. Cl.[7] ..... D21H 25/04

(52) U.S. Cl. ..... 162/206; 162/135; 428/409; 428/137; 428/144

(58) Field of Search ..... 162/135, 205–207, 162/137, 361, 358.3; 428/409, 141, 191, 98, 137, 144; 100/38, 40, 334, 162 R, 193, 73–74

(56) References Cited

U.S. PATENT DOCUMENTS

| | | | | |
|---|---|---|---|---|
| 4,596,633 A | | 6/1986 | Attwood | 162/206 |
| 4,670,102 A | * | 6/1987 | Maurer et al. | 162/361 |
| 4,749,445 A | | 6/1988 | Vreeland | 162/206 |
| 5,033,373 A | | 7/1991 | Brendel et al. | 100/38 |
| 5,080,758 A | | 1/1992 | Horng | 162/130 |
| 5,163,364 A | | 11/1992 | Bubik et al. | 100/38 |
| 5,251,551 A | | 10/1993 | Abe et al. | 100/93 RP |
| 5,378,497 A | | 1/1995 | Johnson et al. | 427/211 |
| 5,400,707 A | | 3/1995 | Neider et al. | 100/93 RP |
| 5,483,873 A | | 1/1996 | Koivukunnas | 100/38 |
| 5,524,532 A | | 6/1996 | Koivukunnas | 100/38 |
| 5,614,064 A | | 3/1997 | Nykopp | 162/358.3 |
| 5,632,101 A | | 5/1997 | Oechsle | 34/445 |
| 5,694,837 A | | 12/1997 | Neider et al. | 100/327 |
| 6,274,001 B1 | * | 8/2001 | Mohan | 162/206 |

FOREIGN PATENT DOCUMENTS

| | | |
|---|---|---|
| WO | 94/28239 | 12/1994 |
| WO | 96/28609 | 9/1996 |

* cited by examiner

*Primary Examiner*—Jose Fortuna
(74) *Attorney, Agent, or Firm*—Ostrager Chong & Flaherty LLP

(57) ABSTRACT

A paperboard product having at least one layer of bleached or semi-bleached pulp and having improved smoothness and reduced bulk loss. For paperboard having sizing without pigment, the smoothness on the printed side, measured by the Parker test is better (lower) than 6.5 when measured using a pressure of 10 kgf/cm$^2$ while the smoothness measured by the Hagerty/Sheffield test is not below 280 Sheffield units. For paperboard having sizing with pigment, the Parker smoothness is less than 5.0 and the Hagerty/Sheffield smoothness is not less than 180 Sheffield units. The web is finished by applying temperature and moisture gradients, then smoothing the web surface using extended nip calendering. The surface temperature of the calendering roll is maintained at 250–400° F. Prior to entering the extended nip, the web surface is moisturized using steam showers. The nipload applied in the heated extended nip is preferably between 300 to 2,500 pli.

2 Claims, 9 Drawing Sheets

PAPERBOARD OF IMPROVED SMOOTHNESS AND BULK

This applications is a division and claims the priority date of U.S. patent application Ser. No. 09/158,483, which was filed on Sep. 22, 1998 now U.S. Pat. No. 6,287,424.

FIELD IF THE INVENTION

This invention generally relates to calendering of paper and paperboard to improve smoothness while minimizing bulk reduction. In particular, the invention relates to calendering of paperboard having high stiffness and good smoothness.

BACKGROUND OF THE INVENTION

Liquid packaging board is a type of paperboard manufactured in the paper industry for packaging liquids such as milk and fruit juices. The product is made using one or more layers of bleached fibers and has requirements of high stiffness and good smoothness. After calendering, in which typically one side is finished to a target smoothness, both sides of the paperboard are coated, e.g., with polyethylene.

Liquid packaging board is also used in the manufacture of aseptic packaging wherein the board is laminated to a foil, e.g., aluminum foil. This laminate is then polyethylene-coated to provide a starting material for the aseptic package. In addition, liquid packaging board is used in other multilayer structures for manufacturing shelf-stable and hot-fill packaging.

The method commonly employed for obtaining good smoothness on this grade of paperboard is to calender the board in multiroll calenders referred to as wet and dry stacks. The process entails overdrying the sheet to obtain a flat moisture profile of 1–2% and then passing it through the wet stack, where water is added to the sheet in one or more calender nips using water boxes. The added moisture and applied pressure in the nips tend to develop good smoothness for the sheet. The moisture pickup is typically greater than 10–12% of the conditioned weight of the paperboard and can sometimes be as much as 15–18% of the conditioned weight of the paperboard. The sheet is then dried in an intercalender region where there can be one or more driers to remove the moisture picked up in the wet stack. The board is then passed through another multiroll stack, with one or more nips where the smoothness is further developed. One of the advantages of waterboxes is that the water applied can have other functional additives such as dyes, lubricants, binders such as starch and film formers such as polyvinyl alcohol.

While the process described is used in several existing manufacturing facilities of liquid packaging board, it has several limitations. First, overdrying of the sheet to reduce the incoming moisture into the wet stack causes the production to be slower if the drying capacity is limited. Even if the drying capacity is not limiting, overdrying involves the cost associated with drying the grade to the targeted moisture levels. Second, the waterboxes present several operational problems, including difficulty during threading and a tendency to cause breaks. Finally, calendering in several nips with a high moisture content in the sheet densifies the web significantly. In other words, the caliper and hence the flexural stiffness are significantly reduced in the wet and dry stacks. The stiffness reduction is compensated by producing the board with more fiber.

In view of the foregoing, alternative methods for improving the smoothness of the board without sacrificing bulk and stiffness are of interest. Smoothness can be developed by allowing the cellulose fibers to replicate a smooth finishing surface. This can be accomplished by heating the fibers to a temperature higher than the glass transition temperature of the fibers and pressing the fibers to a smooth surface. On the other hand, bulk preservation is expected to be better at lower temperatures, where the web is relatively incompressible. The effect of web temperature on bulk preservation of basestock used for liquid packaging board is shown in FIG. 1. The data in FIG. 1 shows that the cooler web (at approximately 80° F.) must be calendered at a much higher line load than the hot web (at approximately 160° F.) to achieve similar caliper reduction.

Temperature gradient calendering is a known process where the surface of the board is heated to a temperature higher than the glass transition temperature of the cellulose in the nip while the temperature of the sheet is substantially cooler. This process enables smoothness development with reduced bulk loss compared to regular machine calendering. In addition, surface moisturization can also be used to lower the glass transition temperature preferentially closer to the surface to develop smoothness without sacrificing bulk. The effect of sheet temperature on bulk preservation during temperature and moisture gradient calendering is shown in FIGS. 2 and 3. The data in FIGS. 2 and 3 shows that for a given Parker smoothness, the caliper that can be attained using a cold web is higher.

Soft calendering, another method of calendering used primarily for coated substrates, also relies on the temperature gradient calendering concept but the web that is being pressed against a hot surface in a nip is supported by a roll that has a resilient cover. The resilient cover gives the paper a longer dwell time in the nip compared to hard steel nips and also allows the smoothness and gloss development to occur at relatively uniform density across the width of the paper. Soft calendering is an expensive option for existing machines and has limitations, such as cover delamination and cracking due to overheating.

A new type of calendering apparatus that extends the soft calendering concept to longer nip widths and reduces the operational problems has been described in recent patent literature. This apparatus is referred to as extended nip calendering and uses an endless band/belt over a backing roll to provide support for the paper web that is pressed against a heated cylinder. Another variation to this concept is to use a shoe instead of a roll as a backing for the paperboard. The backing shoe provides longer nip widths and hence an increased dwell time.

SUMMARY OF THE INVENTION

The present invention is a paperboard product comprising at least one layer of bleached, semi-bleached or unbleached pulp and having improved smoothness and reduced bulk loss. For paperboard having sizing without pigment, the smoothness on the printed side as measured by the Parker test is better (lower) than 6.5 when measured using a pressure of 10 kgf/cm$^2$ while the smoothness measured by the Hagerty/Sheffield test is not below 280 Sheffield units. For paperboard having sizing with pigment, the Parker smoothness is less than 5.0 and the Hagerty/Sheffield smoothness is not less than 180 Sheffield units.

The invention further comprises a method for finishing the above-described paperboard by applying temperature and moisture gradients to the web and then smoothing the web surface using extended nip calendering. In accordance with this method, the surface of the calendering roll is maintained at a temperature of 250–400° F. Prior to entering the extended nip, the web surface can be moisturized using steam showers. In addition to moisturization, the steam shower will also raise the temperature of the surface of the sheet. The nipload applied in the heated extended nip is preferably in the range of 300 to 2,500 pli. This finishing method is superior to waterbox calendering in that it provides a finished product having improved print performance and reduced bulk loss and stiffness.

The invention further comprises a calendering section in which a dry stack of hard calender rolls is retrofitted with a conformable belt for converting from a hard nip calendering apparatus to an extended nip calendering apparatus. The conformable belt may be either an endless belt or a seamed belt that can be seamed in place. Alternatively, the dry stack can be removed and replaced with an extended nip calender, such as a roll-backed or shoe-backed belt calender. In accordance with the retrofitting methods of the invention, the waterboxes on the wet stack of calender rolls are not used and the wet stack is primarily used for caliper control with minimal calendering.

DETAILED DESCRIPTION OF THE PREFERRED EMBODIMENTS

The present invention relates to the finishing of liquid packaging board basestock comprising at least one layer of bleached, semi-bleached or unbleached fibers and having a basis weight in the range of 140–320 lb./3 MSF. In accordance with one preferred embodiment of the invention, the liquid packaging board basestock comprises bleached fibers, which can be either recycled or virgin or a combination thereof. In the case of a multilayer product, the layers can be made of a variety of combinations of bleached softwood and hardwood pulps and other pulps, including bleached chemithermo-mechanical pulp.

Figure 1:
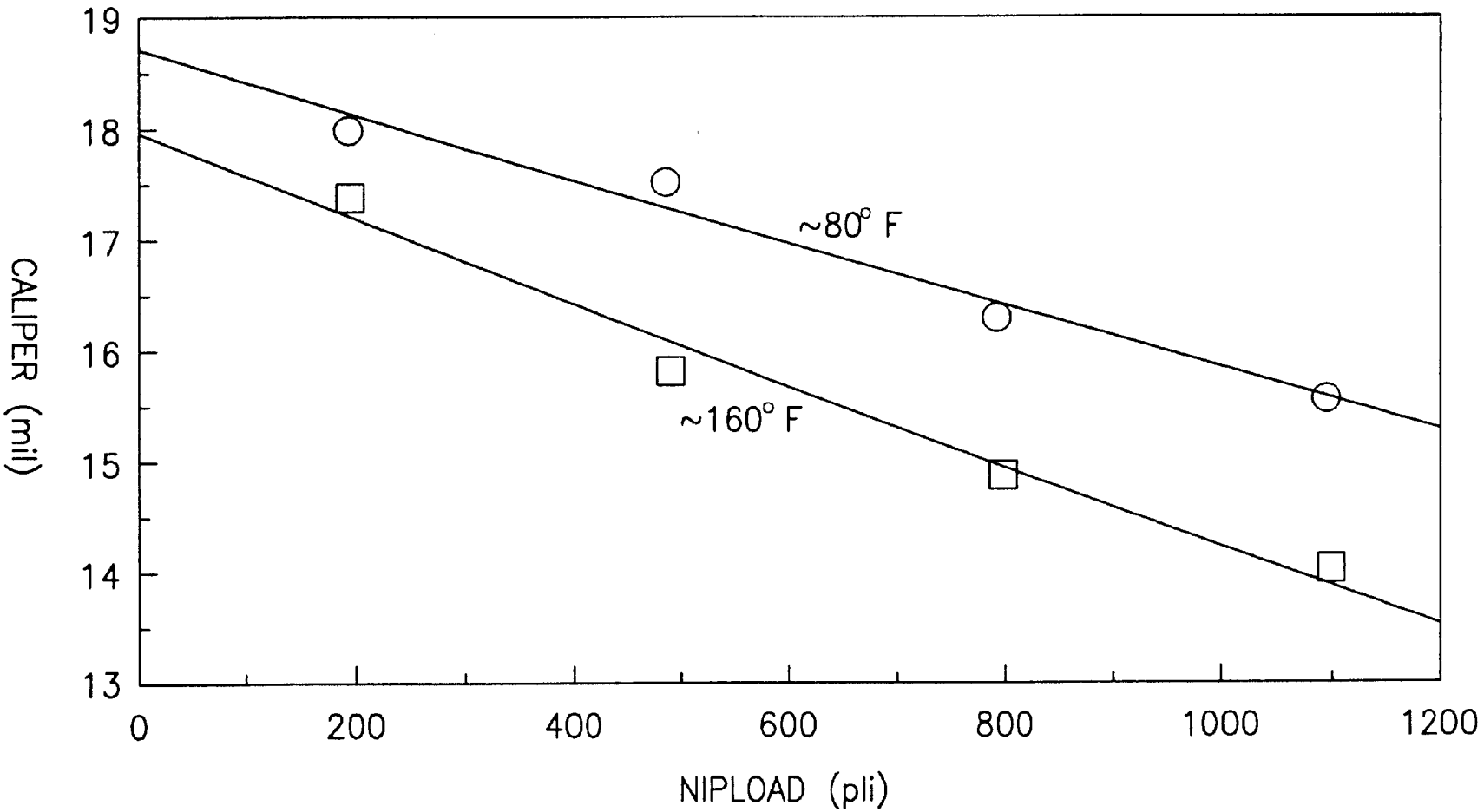
FIG. 1 is a graph of caliper (mils) versus nipload (pli) for liquid packaging board basestock subjected to steel nip calendering (roll temperature=325° F.) at a speed of 1,000 ft/min and at two different web temperatures: (○) ~80° F.; (□) ~160° F.
Figure 2:
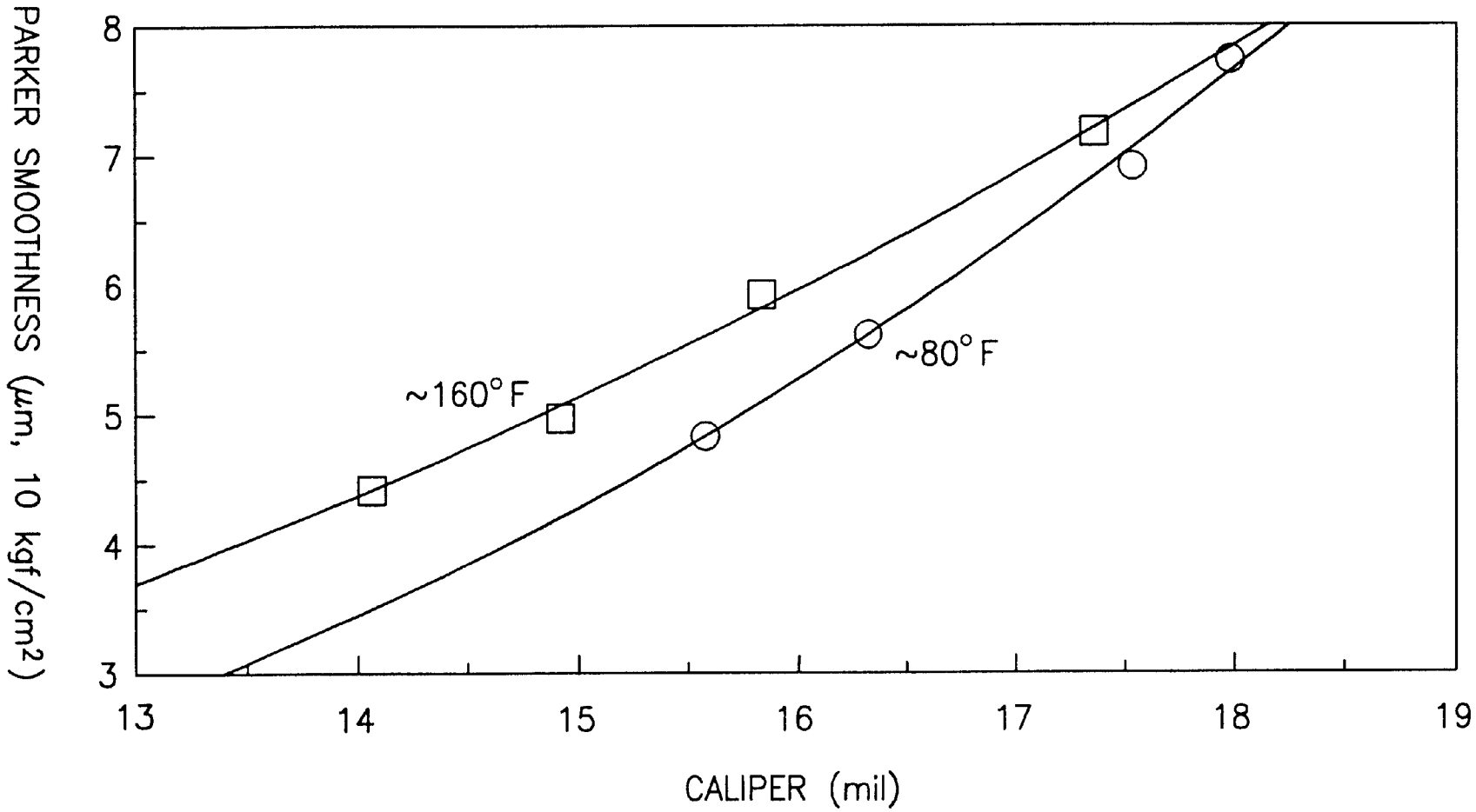
FIGS. 2 and 3 are graphs of Parker smoothness (microns, 10 kgf/cm$^2$) versus caliper (mils) for liquid packaging board basestock subjected to steel nip calendering (roll temperature=325° F.) at a speed of 1,000 ft/min with (FIG. 3) and without (FIG. 2) steam premoisturization and at two different web temperatures: (○) ~80 F.; (□) ~160° F.
Figure 3:
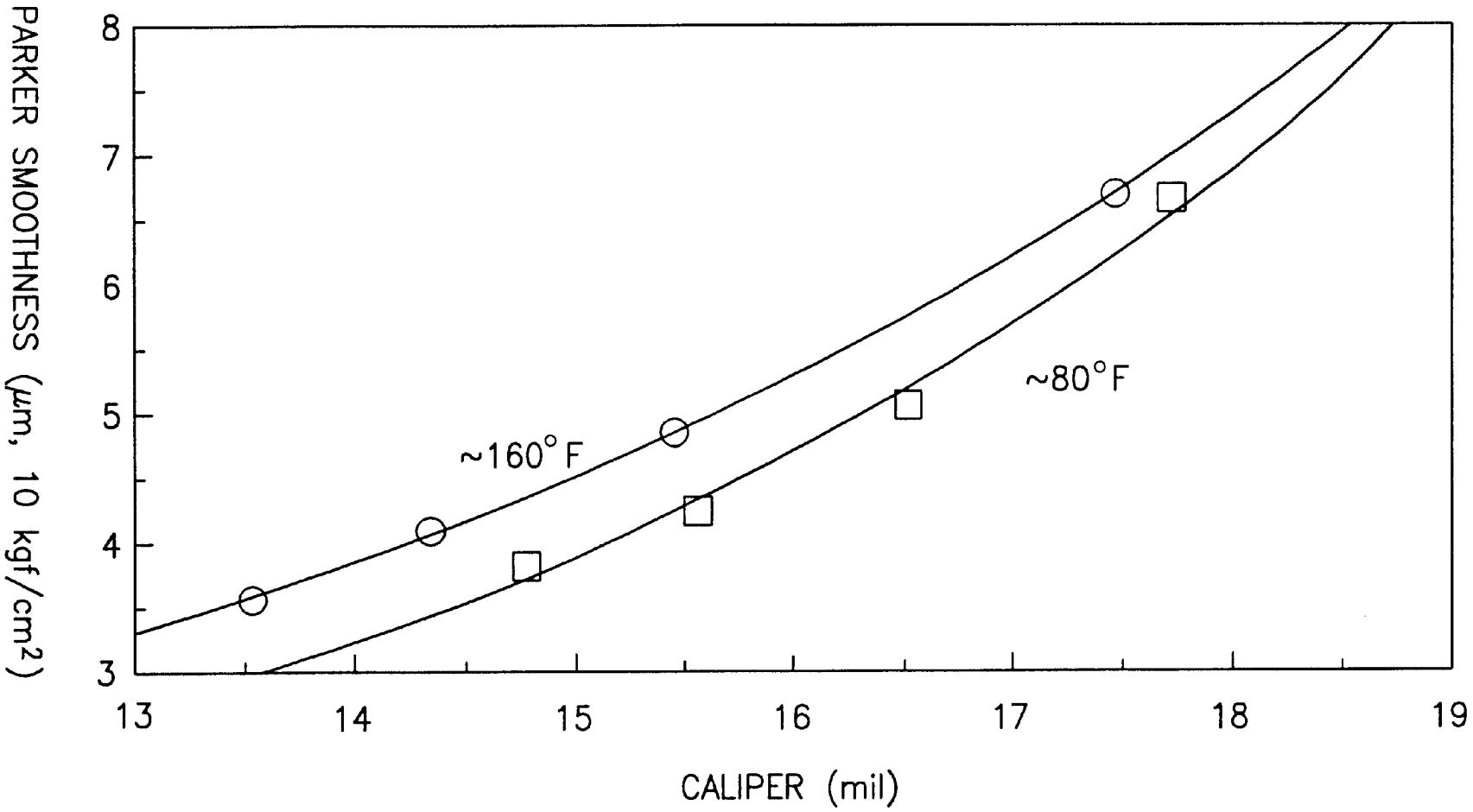
Figure 4:
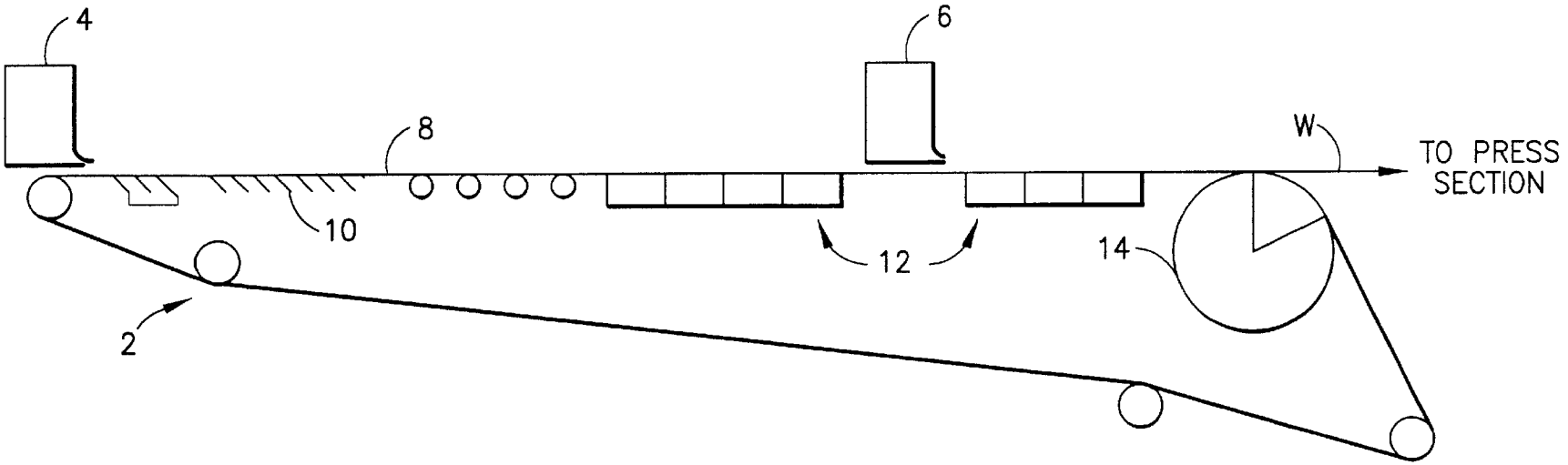
FIG. 4 is a diagrammatic view of a typical arrangement of a Fourdrinier machine fitted with two head boxes suitable for use in manufacturing multilayer paperboard.

Multilayer liquid packaging board basestock can be formed on a papermachine capable of producing multilayer product. A papermachine for making a two-ply product is depicted in FIG. 4. This papermachine is a conventional Fourdrinier machine 2 fitted with two head boxes 4 and 6. The furnishes for the bottom and top plies are supplied to the first and second headboxes 4 and 6 respectively by conventional means. Headbox 4 deposits the bottom ply on a forming table 8 of the Fourdrinier machine. At a suitable position along the forming table 8, vacuum is applied using conventional suction boxes 12 and then headbox 6 adds a top ply to the bottom ply. Water is removed by the foils 10 and by the suction roll 14. The web exits the Fourdrinier machine and enters a conventional press section (not shown), which removes additional water.

Following pressing, the paperboard web is dried in the main dryer section (not shown) of the papermachine. The dried web is then optionally surface sized at a size press 16 (e.g., of the puddle or metering type) where the amount of pickup can be controlled. sizing operations are carried out primarily to provide paper/paper-board with resistance to penetration by aqueous solutions. The treatment also improves the surface characteristics and certain physical properties of the paper/paperboard. During surface sizing, surface voids in the sheet are filled with starch or other binder particles. In the alternative, the size press may be substituted for a coating station, such as a film coater, to transfer a pigmented, high-solids coating to the surface of the paperboard. Alternatively, a coating can be applied using a blade coater.

Figure 5:
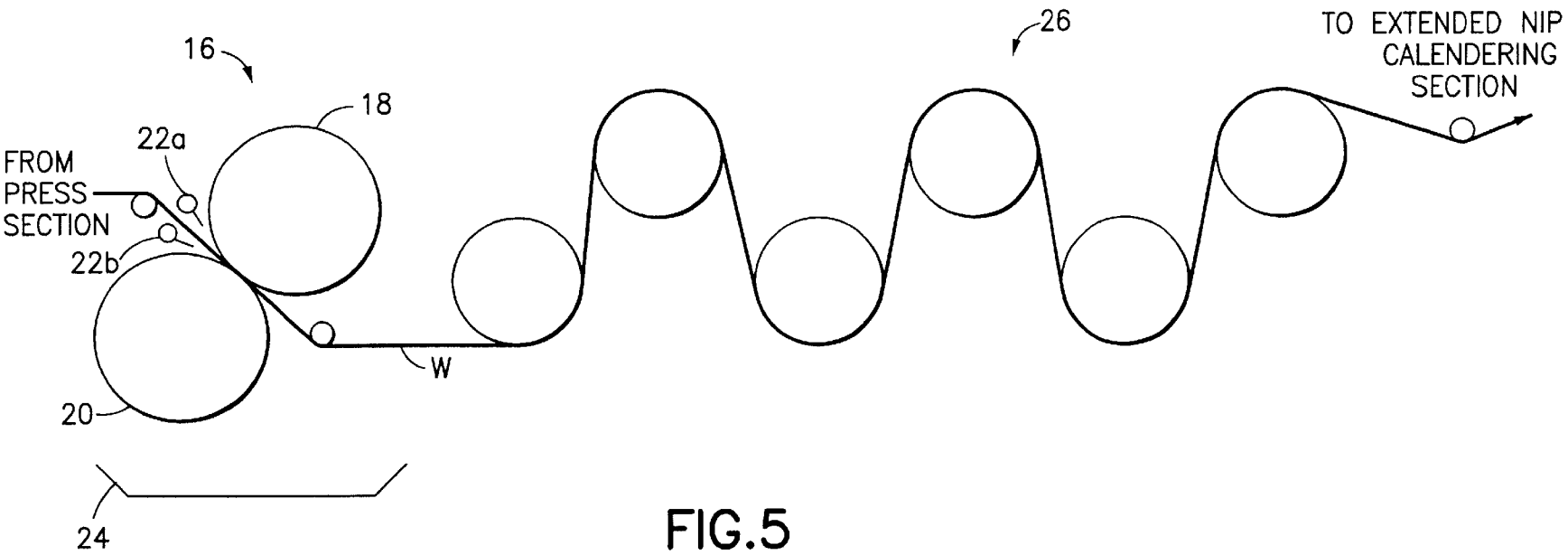
FIG. 5 is a diagrammatic view of a representative size press and dryer section which can be used in manufacturing paperboard.

FIG. 5 shows a size press 16 having an inclined configuration. However, it will be appreciated by persons skilled in the art that the use of an inclined configuration is not necessary. In the alternative, the size press may be horizontal or vertical or have metering elements such as a rod or blade. In the inclined size press shown in FIG. 5, the web W passes through the nip between a pair of opposing size press rolls 18 and 20 at an angle of inclination between 0 and 90°, e.g., 45°. The nip formed by rolls 18 and 20 is flooded with sizing solution supplied on both sides of the web by respective banks of solution supply tubes 22*a* and 22*b* spaced in the sheet cross direction. The web W absorbs some of the solution and the unabsorbed solution is removed by the pressure in the nip. The overflow solution is collected in a pan 24 arranged directly below the press rolls and is recirculated back to the nip through the solution supply tubes.

The size press 16 can be used to add a variety of agents for a variety of purposes (e.g., starch and poly-vinyl alcohol for strength, pigments such as calcium carbonate, clay for improving the brightness and smoothness of the product). The starch solution (e.g., unmodified, acid modified, pre-oxidized or hydroxyethylated) may have a starch concentration in the range of 1–10%. In addition, the size press solution may optionally contain a lubricant that is compatible with the starch and other binders. This lubricant can belong to a class of polyethylene emulsions or can be a polyglyceride. The size press-treated paperboard is dried in the dryer section 26 to a moisture level of 4–6%.

Figure 6:
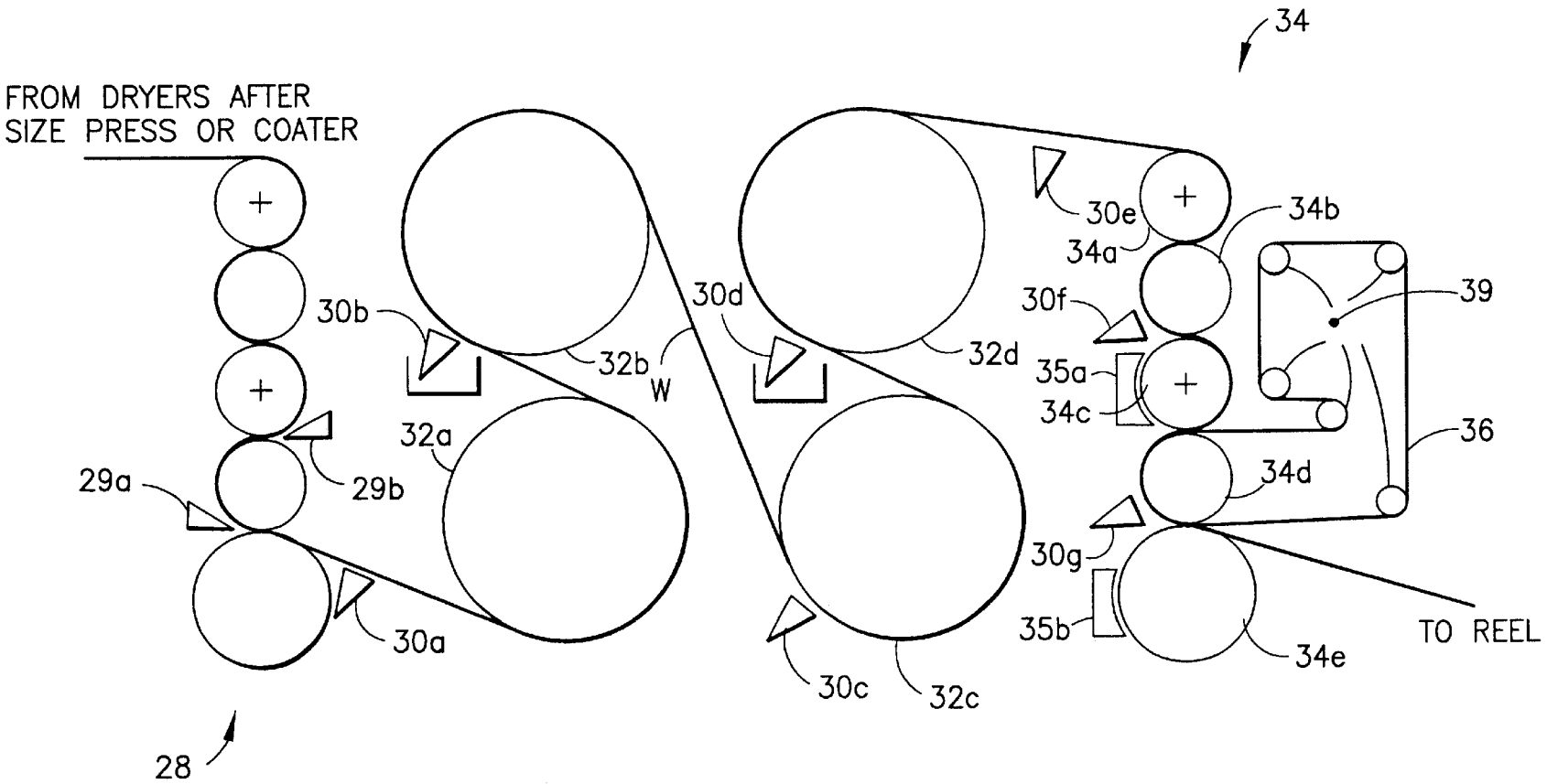
FIG. 6 is a diagrammatic view of a known calendering section of a papermachine which has been retrofitted to an extended nip calendering arrangement in accordance with one aspect of the invention.

Following the size press treatment and drying, the paperboard is passed through a first multi-roll calender stack 28 shown in FIG. 6. The calender stack 28 may be equipped with one or more conventional waterboxes. FIG. 6 shows a wet stack 28 having two conventional water-boxes 29*a* and 29*b* which conventionally apply water to respective sides of the paperboard. As described in greater detail hereinafter, because the machine calendering line shown in FIG. 6 is retrofitted with moisturizing showers, the waterboxes are not used to apply moisture to the paperboard, i.e., the waterboxes are either removed or left in place but not activated to apply liquid to the paper web. Furthermore, in accordance with the invention, the wet stack 28 is used to pull the web, while the last nip in the wet stack being used for caliper control with minimal calendering.

After the paperboard web W has passed through the stack 28, the web is moisturized on one or both sides using one or more moisturizing showers 30. The moisturizing showers may consist of water showers (e.g., hydraulic, air atomized or ultrasonic showers) or steam showers or combination of water showers and steam showers.

The web may optionally be wrapped around a pair of intercalender dryers, which can be used as cooling cylinders, in an S-shaped configuration, before entering a dry calender stack 34. Calender stack 34 comprises calender rolls 34*a*–34*e*, at least one of which is heated. The intercalender dryers 32*a* through 32*d* are located between calender stacks 28 and 34, and can be used to cool the web W to reduce the average sheet temperature by circulating cold water or other heat transfer fluid. Alternative means of cooling, such as air showers or cooling cylinders, may be used in place of the existing intercalender dryers. The last one or two intercalender dryers may also be used to raise the surface temperature of the sheet that is to be calendered. The cool web exits the intercalender region with an average temperature in the range of 100° to 180° F.

Each moisturizing shower 30 comprises a bank of independently controlled nozzles which are spaced at regular intervals in the cross direction (CD). The supply of fluid or steam to each nozzle is controlled by a computer (not shown), which receives moisture level feedback from moisture detectors (not shown), e.g., gamma gauges, situated downstream of the moisturizing showers, e.g., at the reel. The computer-controlled nozzles selectively apply moisture to the web to correct for nonuniformities in the CD moisture profile. The amount of moisture addition will range from 0.25–4% by weight per side. While moisture addition may be restricted to the printed side of the board, some moisturization on the opposite side may be required to control curl during the production. The moisture addition will be done in such a way that a uniform moisture level will be applied after the profiling is accomplished. The profiling and moisture addition can be done by a combination of one of more showers. If steam showers are used in conjunction with water showers, the preferred configuration would have the steam showers following the water showers. The location of the moisturizing showers will be such that the dwell time between moisturization and the heated nip location varies between 0.05 and 6 sec. Possible locations of the moisturizing showers 30 are shown in FIG. 6, e.g., shower 30*a* located after calender stack 28 and before the first intercalender dryer 32*a*; showers 30*b*–30*d* respectively located adjacent the second, third and fourth intercalender dryers 32*b*–32*d*; shower 30*e* located after the fourth intercalender dryer 32*d* and before calender stack 34; shower 30*f* located adjacent calender roll 34*b*; and shower 30*g* located adjacent calender roll 34*d*.

In accordance with one preferred embodiment of the invention, a soft, i.e., conformable, endless belt 36 is installed such that the belt is partially wrapped round calender roll 34*d*, which is unheated, to form a first extended nip with calender roll 34*c*, which is eated, e.g., by an external induction heater 35*a*. The belt presses the web against the surface of the heated calender roll. The belt 36 is supported by a plurality of guide rolls 39 and by calender roll 34*d*. Although FIG. 6 shows belt calendering of the wire side of the web, alternative arrangements can be used to calender the felt side instead. For example, the felt side can be calendered by wrapping the belt around calender roll 34*c* and then heating calender roll 34*b* instead of calender roll 34*c*.

In accordance with the preferred embodiment shown in FIG. 6, the calendered side of the web W is moisturized using a moisturizing shower 30*f*, i.e., steam shower. In addition to moisturization, the steam shower will also raise the temperature of the surface of the calendered side of the web. The moisturized side of web W is then smoothed as it passes through the hot extended nip formed by heated calender roll 34*c* and conformable belt 36. The steam shower 30*f* is located very close to the first extended nip between rolls 34*b* and 34*c* so that the time between steam application and hot extended nip calendering is minimized. Minimizing this time will preserve a gradient in moisture across the thickness of the web. In cases where more than one moisturizing shower is used to apply moisture to the same side, the last shower that applies moisture should be located as close to the extended nip as possible. Preferably the dwell time between the moisturization using the steam shower 30*f* and calendering in the first hot extended nip is 0.01 to 6 sec. The nipload in the heated nip between rolls 34*c* and 34*d* can range from 300 to 2,500 pli. Preferably, the calender roll 34*b* is raised to eliminate the hard nip between rolls 34*b* and 34*c*, so that the finished side of the web will not be steel nip calendered before entering the first hot extended nip.

As depicted in FIG. 6, optionally calender roll 34*e* may also be heated, e.g., by external induction heater 35*b*, to provide a second hot extended nip for further smoothing of the calendered side of the web W. Optionally, the web can be remoisturized by moisturizing shower 30*g* before the web enters the second extended nip formed by heated calender roll 34*e* and conformable belt 36. Because the pressure in each nip is a function of the weight of the calender rolls above that nip, the nip pressure will be greater in the extended nip between belt 36 and roll 34*e* than the nip pressure in the extended nip between belt 36 and roll 34*c* unless an adjustment is made. The niploads in the two extended nips can be equalized by conventional means, e.g., by installing compression springs to partially support roll 34*d*, the spring force being roughly equal to the weight of roll 34*d*.

In accordance with the preferred embodiment of the invention, calender rolls 34*c* and 34*e* may be heated by conventional external induction heater 35*a* and 35*b*, respectively. However, it will be appreciated by persons skilled in the art that other conventional means could be used to heat calender rolls 34*c* and 34*e*. For example, the hot pressure nips can be created by heating one or more of the rolls in the second stack using internal steam, circulating oil or other heating fluid, internal or external induction coils, direct heating or infrared heating. The heat input into the rolls should be sufficient to maintain a roll surface temperature of 250–400° F. during calendering of the web.

Although the calendering line shown in FIG. 6 comprises two calender stacks separated by intercalender dryers, it should be appreciated that to finish the liquid packaging board of the invention, at a minimum, requires only a single calender stack having a single extended nip. Thus, wet stack 28 and intercalender dryers 32*a*–32*d* can be eliminated. Furthermore, the single calender stack could be a simple two-roll calender. When intercalender dryers are present, they are normally used to dry the sheet to lower the moisture that the web picks up in the wet stack. In the present invention, this drying is not needed because the water-boxes on the wet stack are not used. Therefore, the intercalender dryers can be used to cool the sheet by running cold water or other cooling fluid through them.

In a dry stack retrofitted with an endless belt, the belt is preferably formed using a fabric base and coated using a polymeric material such as a polyurethane. The belt is pre-formed in that it is supplied as a continuous loop. The finished belt preferably has a hardness from 58 Shore A to 88 Shore C and a thickness of 5–15 mm, and preferably is finished to a surface roughness of no greater than 8 $\mu$m RMS. In addition, the uniformity of the belt will be such that the thickness variation across the width of the papermachine will be no greater than 0.02 mm. The loop length of the belt will be optimized to be located in the available space in the dry stack and also have sufficient cooling outside the nip. Installation of endless belts on the calender stack may be an involved procedure. As an alternative to endless bands, the belt can be seamed in place and the seam covered with a material that minimizes marking due to the seam in the calendering operation. The belt physical properties will be chosen such that the nip width can range from 1 to 10 cm or the nip residence time is in the range of 0.001 to 20 msec.

One aspect of the present invention is to retrofit a conventional machine calendering section by installing a conformable belt. In addition, the conventional machine calendering section may be retrofitted with moisturizing showers and external induction heaters, as hown in FIG. 6.

Figure 8:
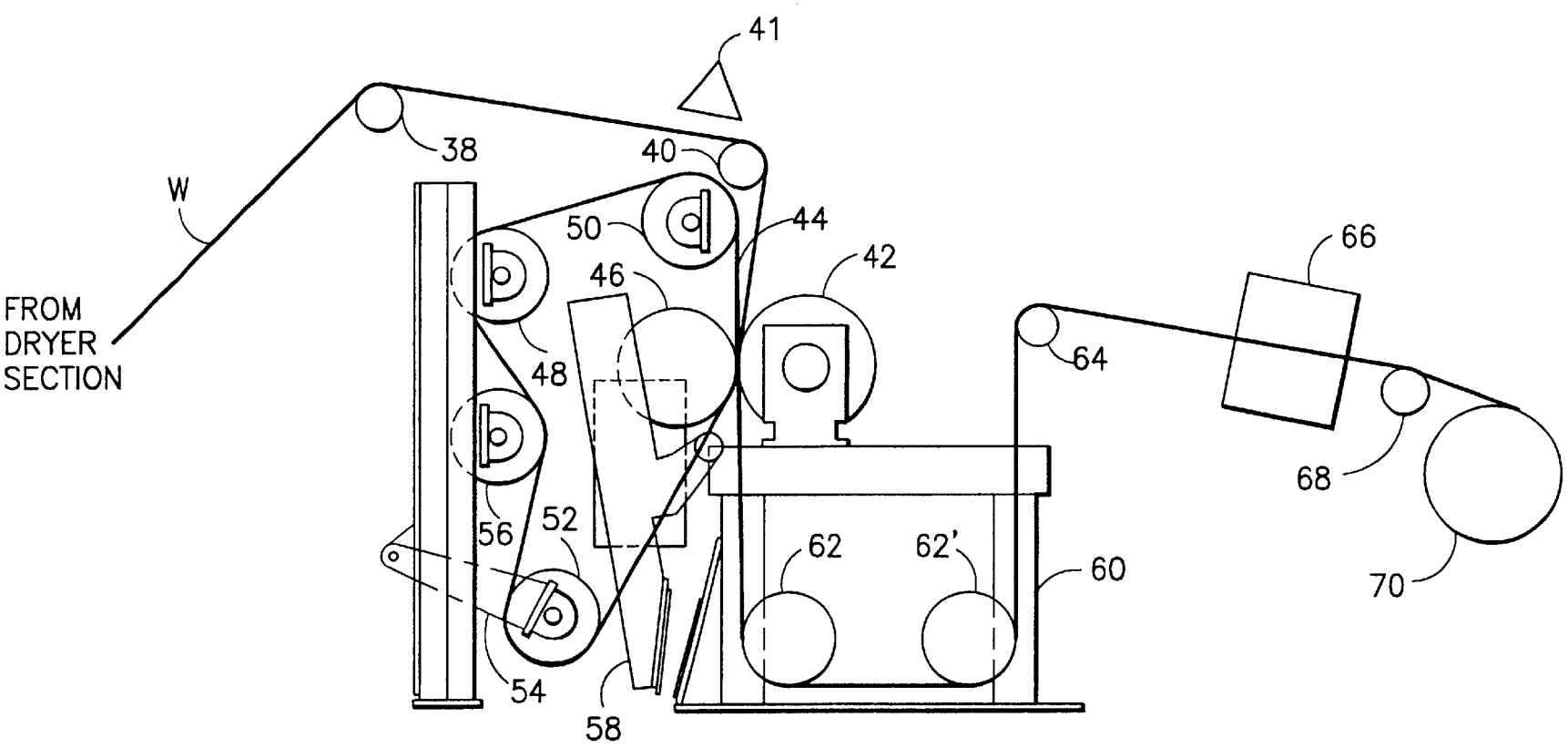
FIG. 8 is a diagrammatic view of an alternative extended nip calendering arrangement which can be used to finish paperboard in accordance with the invention.

In accordance with a further alternative, the liquid packaging board of the invention may be manufactured by installing a belt calendering arrangement of the type shown in FIG. 8 in place of the dry stack. The belt properties used in a new calender installed in place of an existing dry stack will also be similar to the properties described for the retrofitted calenders. Cooling means other than intercalender dryers, such as cooling cylinders, chill boxes, chill rolls and air showers, can be used to cool the side of the paperboard which is not contacted by the heated calender roll of the belt calendering arrangement.

Referring to FIG. 8, the tension in the web W can be adjusted by changing the position of a tensioning roll 38 utilizing any conventional tensioning device (not shown). The web is wrapped partly around a guide roll 40 and passes through an extended nip formed by a heated calender roll 42 and a conformable belt 44 made of resilient material. The position of guide roll 40 is adjustable to increase the angle of contact of the web W with the heated calender roll 42 upstream of the extended nip, which angle of contact determines the amount of preheating applied to the web by the heated calender roll. Before entering the nip, the web W is optionally moisturized by a bank of moisturizing showers 41 of the type previously described. The web W is pressed against the heated calender roll 42 by a backing roll 46 which exerts a load on the belt 44. The belt 44, which may be either endless or seamed, circulates on carrier rolls 48 and 50 and tensioning roll 52. The tensioning roll 50 is rotatably mounted on the end of a pivotable arm 54. A guide roll 56 is located outside and in contact with the circulating belt. The backing roll 46 is rotatably mounted on a loading arm 58, which is in turn pivotably mounted on a support frame 60. The loading arm has a first angular position (shown in FIG. 8) in which the backing roll 46 presses the belt 44 against the heated calender roll 42 and a second angular position (not shown in FIG. 8) in which the belt is relaxed and separated from the heated roll by a gap.

The heated calender roll surface, when pressed against the printed side of the web W, applies heat. The residence time of the web in the extended nip is sufficiently short that the heat does not penetrate through the entire thickness of the web. The applied heat raises the surface temperature of the paperboard to the glass transition temperature, which causes the fibers to soften and conform to the surface of the heated calender roll 42. The gradient in the temperature tends to lower the glass transition temperature preferentially on the printed side of the web, allowing the web to achieve a desired smoothness and a desired printing performance without significant reduction in caliper or stiffness. The calendered web passes under guide rolls 62 and 62' and then over guide roll 64. A scanning sensor unit 66 measures the moisture level and basis weight of the web. The web then passes over guide roll 68 on its way to a winding roll 70.

Figure 9:
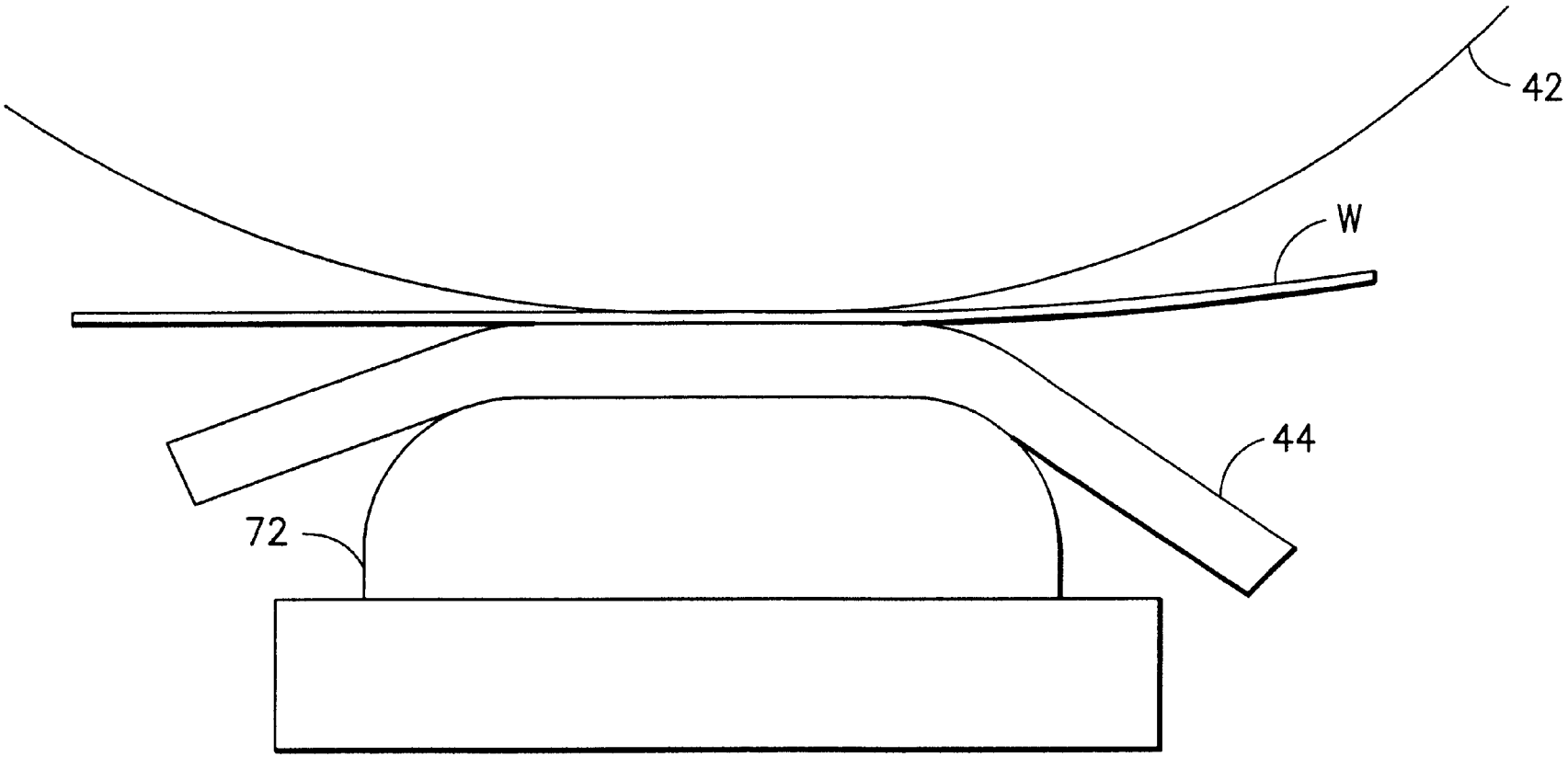
FIG. 9 is a diagrammatic view of an extended nip calendering arrangement in which the conformable belt is supported against the heated calender roll by means of a backing shoe.

In accordance with another preferred embodiment of the paperboard finishing apparatus, the backing roll can be replaced by a backing shoe to provide a greater nip width. An example of such an extended nip calendering arrangement is depicted in FIG. 9. This extended nip calendering arrangement comprises a heated calender roll 42, a conformable belt 44 made of resilient material and a backing shoe 72. The backing shoe 72 is urged toward the heated calender roll 42 by means of loading elements (not shown). During belt operation, the belt 44 glides over the crown surface of the backing shoe. To reduce friction during gliding, lubricating ôil is supplied between the bottom surface of the belt and the crown surface of the backing shoe by an oil lubrication system not shown in FIG. 9. The nip width is determined by the width of the crown of the backing shoe, the radius of the heated calender roll and the thickness of the belt.

The results achieved in an extended nip calender are determined in part by the properties of the belt. In particular, the modulus of elasticity of the belt affects the deformation of the belt in the nip. By making the belt of a very soft material, e.g., polyurethane on a fabric substrate, web bulk can be saved during calendering.

Utilizing the apparatus shown in FIG. 6 or 8 with a hot calender surface temperature of either 300° or 400° F. and calender nipload which varied from 400 to 1,200 pli, the calendered top surface of a 178 lb./3 MSF paperboard web having sizing without pigment had the following attributes: (1) the smoothness as measured by the Parker test (TAPPI Test Method T 555 om-94) was better (lower) than 6.5 when measured using a pressure of 10 kgf/cm$^2$; and (2) the smoothness as measured by the Hagerty/Sheffield test (TAPPI Test Method T 538 om-88) was not less than 280 Sheffield units. Alternatively, in the case where the paperboard has sizing with pigment, the Parker smoothness is less than 5.0 and the Hagerty/Sheffield smoothness is not less than 180.

The extended nip calendering method of the invention significantly improves the microscale smoothness over the macroscale smoothness. This finding is new in that while previous references of belt calendering discuss the potential of obtaining a gloss uniformity, they do not allude to a preferential improvement of microscale smoothness over macroscale. Here the term microscale is being used to refer to a scale where roughness can be characterized by the aforementioned test for Parker smoothness while macroscale refers to a length scale where roughness can be characterized using the Sheffield/Hagerty test. Most production facilities of liquid packaging board use the Sheffield test as a quality control for smoothness measurement. The results from the Parker instrument, however, can be more indicative of the print performance of a product.

Figure 7:
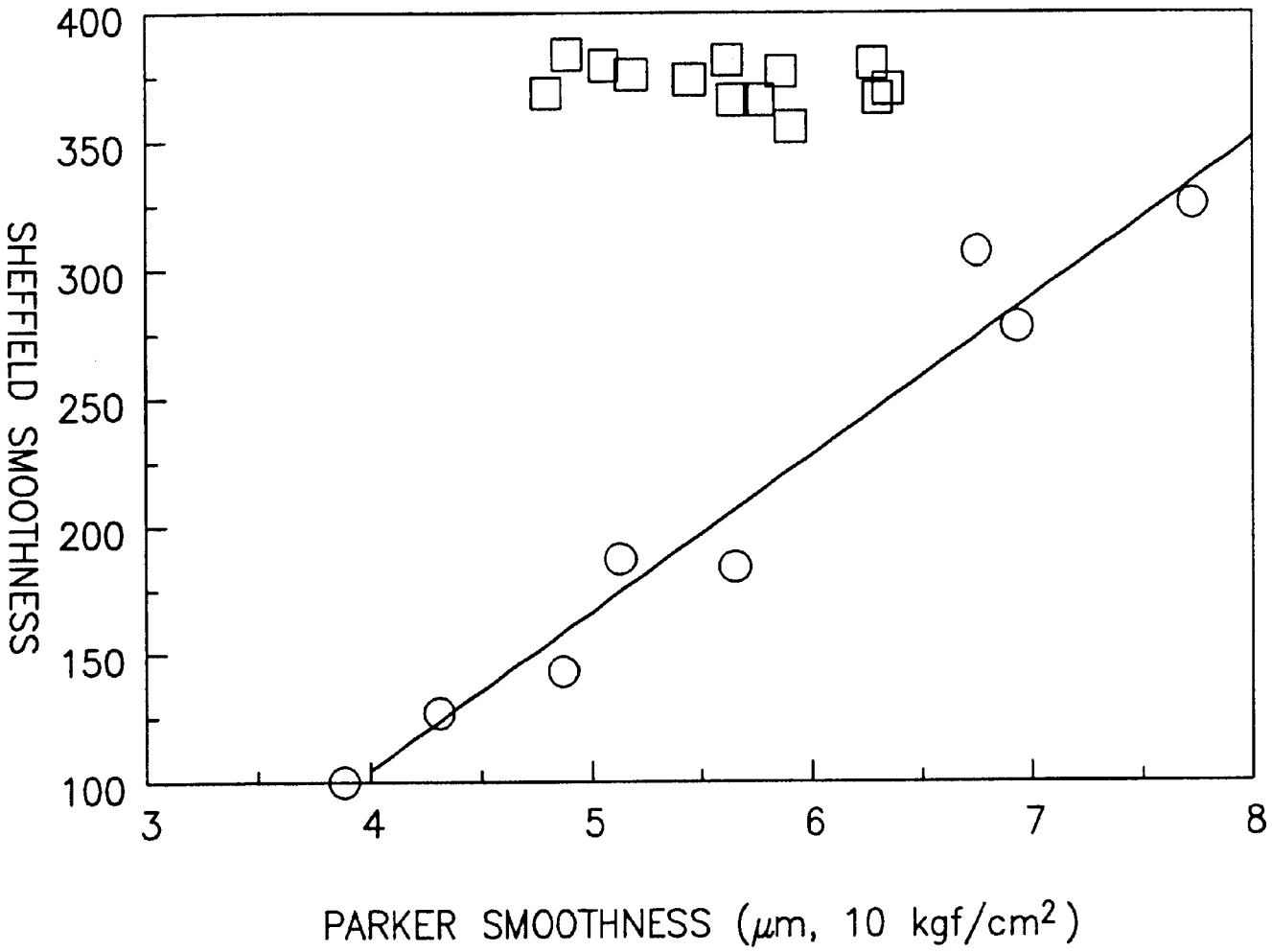
FIG. 7 is a graph of Sheffield smoothness versus Parker smoothness (microns, 10 kgf/cm$^2$) for the top surface of 178 lb./3 MSF liquid packaging board basestock made by steel nip calendering (○) and extended nip calendering of the roll-backed type (□). The surface temperature of the calender roll in the belt calendering case was varied from 300° to 400° F. and the nipload varied from 400 to 1,200 pli; for steel nip calendering the surface temperature was 325° F. while the nipload was varied from 200 to 1,100 pli.

The differences in smoothness development using the belt calendering method of the invention and conventional steel nip calendering are illustrated in FIG. 7. The data was generated for liquid packaging board basestock calendered using a pilot facility. The belt calendering was conducted in a roll temperature range of 300° to 400° F., while the steel nip calendered product was calendered at a roll temperature of 325° F. From this data, it can be inferred that steel nip calendering produces a sheet wherein the microscale smoothness tracks the macroscale smoothness. On the other hand, the belt calendered product has significant improvement in microscale smoothness without a substantial change in macroscale smoothness. In other words, in order to obtain the same level of microscale smoothness as a belt-calendered product, the board calendered using the hot hard nip calendering needs to achieve a much higher level of macroscale smoothness. This can lead to heterogeneity in the densification of the paperboard as well as in its compressibility, which can be manifested as gloss mottle and print voids.

Another important feature of the present invention is the use of intercalender dryers and moisturizing showers to cool the web prior to calendering. It is known that calendering of a cooler web can result in better bulk than calendering a hot web and the practice of temperature gradient calendering is based on this principle. The moisturizing showers provide a rapid method of cooling and also reduce the glass transition temperature, as well as correct for moisture profile nonuniformity.

One possible variation of the invention involves eliminating the size press operation and calendering a multilayer product that is not surface sized. Another variation involves calendering the board ahead of the belted nips with a steel nip which can be used to control the caliper of the board. The steel nip can be heated using controlled zone heating such as that provided by commercially available induction heating systems. Alternatively, the nip loading mechanism could be such that a precise profile can be maintained to reduce caliper variation across the web. Yet another variation of the proposed process would involve performing the caliper profiling in the extended nip. This can be accomplished by zone-controlled heating on the finishing roll and also varying the applied pressure across the width by hydraulic means. Another variation of this invention is to add moisture in such a way that the additional drying capacity of the intercalender dryers is used for improving the speed of the machine.

The foregoing preferred embodiments of the invention have been disclosed for the purpose of illustration. Other variations and modifications of the disclosed method of extended nip calendering will be readily apparent to practitioners skilled in the art. All such variations and modifications which do not depart from the concept of the invention are intended to be encompassed by the claims set forth hereinafter.

What is claimed is:

1. A paperboard product comprising at least one ply having a surface suitable for printing, said at least one ply comprising bleached, semi-bleached or unbleached pulp, wherein said surface of said ply has a Parker smoothness less than 6.5 and a Hagerty/Sheffield smoothness greater than 285 Sheffield units.

2. A paperboard product having a basis weight in a range of 140 to 320 pounds per 3,000 square feet and comprising at least one ply, said one ply comprising bleached, semi-bleached or unbleached pulp and having a pigmented coating on a surface thereof, said coated surface of said ply having a Parker smoothness less than 5.0 and a Hagerty/Sheffield smoothness not less than 180 Sheffield units.

* * * * *